US009828827B2

(12) United States Patent
Kellner et al.

(10) Patent No.: US 9,828,827 B2
(45) Date of Patent: Nov. 28, 2017

(54) COMPOSITE SEGMENTING BACKUP RING FOR A SUBTERRANEAN PLUG

(71) Applicant: BAKER HUGHES INCORPORATED, Houston, TX (US)

(72) Inventors: Justin C. Kellner, Adkins, TX (US); Edward J. O'Malley, Houston, TX (US); Clint Mickey, Spring, TX (US); Steve Rosenblatt, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 644 days.

(21) Appl. No.: 14/261,891

(22) Filed: Apr. 25, 2014

(65) Prior Publication Data

US 2015/0308215 A1 Oct. 29, 2015

(51) Int. Cl.
*E21B 33/128* (2006.01)
*E21B 33/129* (2006.01)

(52) U.S. Cl.
CPC ..... *E21B 33/128* (2013.01); *E21B 33/129* (2013.01); *E21B 33/1291* (2013.01)

(58) Field of Classification Search
CPC .. E21B 33/128; E21B 33/1291; E21B 33/129; E21B 33/134; E21B 33/1216
See application file for complete search history.

(56) References Cited

U.S. PATENT DOCUMENTS 4,524,825 A * 6/1985 Fore ..... E21B 33/1292 166/139
5,701,959 A * 12/1997 Hushbeck ..... E21B 33/1293 166/118
7,735,549 B1 * 6/2010 Nish ..... E21B 33/134 166/134
8,205,671 B1 6/2012 Branton
8,579,023 B1 * 11/2013 Nish ..... E21B 33/128 166/118
2002/0043368 A1 * 4/2002 Bell ..... E21B 33/1216 166/118
2002/0070503 A1 * 6/2002 Zimmerman ..... E21B 33/1208 277/337
2008/0060821 A1 * 3/2008 Smith ..... E21B 33/1216 166/387
2008/0308266 A1 12/2008 Roberts et al.
2010/0132960 A1 6/2010 Shkurti et al.
2012/0217025 A1 8/2012 Shkurti et al.
(Continued)

*Primary Examiner* — Michael Wills, III
(74) *Attorney, Agent, or Firm* — Steve Rosenblatt

(57) ABSTRACT

A composite plug that can be used in fracturing has backup rings for the seal that are preferably made of a composite material. The backup rings are essentially connected segments that allow the connections to break when the plug is set and the cones are brought closer together. When the rings break to form gaps between segments in a specific ring, the adjacent ring has offset gaps so that as a whole there are no extrusion gaps that would allow the seal element to pass. The rings can be rotationally locked to each other initially at the adjacent segments that are formed when the plug is set to maintain their relative positions so that gaps between segments adjacent the seal are overlapped with segments from the adjacent ring. The segmenting backup rings can be used on one or on both sides of a sealing element.

19 Claims, 2 Drawing Sheets

(56) References Cited

U.S. PATENT DOCUMENTS

| | | | | |
|---|---|---|---|---|
| 2013/0112398 | A1* | 5/2013 | White | E21B 33/1216 166/118 |
| 2013/0112412 | A1 | 5/2013 | Frazier | |
| 2013/0306330 | A1 | 11/2013 | Bishop et al. | |
| 2014/0190682 | A1* | 7/2014 | Greenlee | E21B 33/13 166/118 |

* cited by examiner

COMPOSITE SEGMENTING BACKUP RING FOR A SUBTERRANEAN PLUG

FIELD OF THE INVENTION

The field of the invention is composite plugs and more specifically where the anti-extrusion members are made of a non-metallic material and during the setting form segments that allows sealing in situations with increased radial extension of the sealing element.

BACKGROUND OF THE INVENTION

Some completion procedures require a series of plugs for sequential operations in one zone while isolating already treated zones. At the end of the operation for all the zones, the plugs are typically removed. One fast way to remove such plugs is to drill them out. To facilitate drilling out the plugs are made from materials that can be drilled out fast such as composites. The design challenges are to build a barrier that will hold large pressure differentials while being amenable to a fast drilling out. Along those lines manufacturers have made more component parts from composite materials but the extrusion rings that are disposed on opposed sides of the sealing element to contain the sealing element when in the radially extended and set position. These backup rings have been a stack of thin circular sheets that bend into an L shape when the seal element is compressed. These stacks of thin metal rings are difficult to mill out. Typical of such designs is US 2013/0112412.

What is needed and provided by the present invention is a backup ring system that can tolerate high degree of expansion and still be easy to drill out. The high degree of expansion can be made necessary if there is a constriction in the tubular string for any reason and the plug needs to get past the constriction and still be operative to be set at another location for holding anticipated differential pressures. The backup ring system presents a plurality of connected rings that have weak connections such that on setting using cones that ramp out slips and the backup rings the rings break into segments defining gaps between the segments in each ring. The segment gaps in one ring are offset from segment gaps in the adjacent ring to present an effective extrusion barrier while using preferably composite components for the rings. These and other features of the present invention will be more readily apparent to those skilled in the art from a review of the detailed description of the preferred embodiment and the associated drawings while recognizing that the full scope of the invention is to be determined from the appended claims.

SUMMARY OF THE INVENTION

A composite plug that can be used in fracturing has backup rings for the seal that are preferably made of a composite material. The backup rings are essentially connected segments that allow the connections to break when the plug is set and the cones are brought closer together. When the rings break to form gaps between segments in a specific ring, the adjacent ring has offset gaps so that as a whole there are no extrusion gaps that would allow the seal element to pass. The rings can be rotationally locked to each other initially at the adjacent segments that are formed when the plug is set to maintain their relative positions so that gaps between segments adjacent the seal are overlapped with segments from the adjacent ring. The segmenting backup rings can be used on one or on both sides of a sealing element.

DETAILED DESCRIPTION OF THE PREFERRED EMBODIMENT

Figure 1:
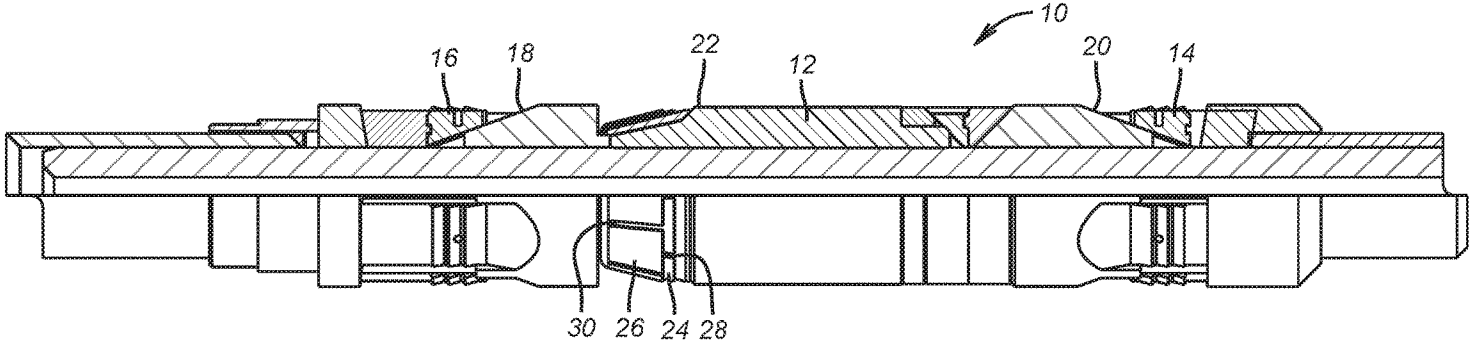
FIG. 1 is part section view of a first embodiment showing the segmenting rings on one side of the sealing element and metallic petal type rings on an opposite side.

FIG. 1 illustrates a composite plug 10 that has a sealing element 12 as well as slip assemblies 14 and 16 that respectively ride on cones 20 and 18. At end 22 of element 12 is a series of petal rings in two rows 24 and 26 with the rings each having slots 28 and 30 to allow them to extend to a surrounding tubular that is not shown to prevent extrusion of the sealing element 12 in the set position. At end 22 the use of the stacked petal rings in rows 24 and 26 can extend the time it takes to drill out the plug 10 because the petal rings are invariably metallic. The design described above is not new per se because it is shown in US 2013/0112412 but it is illustrated in FIG. 1 to show that the present invention can be deployed as a backup system at one end of a sealing element 12 or at opposed ends as shown in FIGS. 2 and 3.

Figure 2:
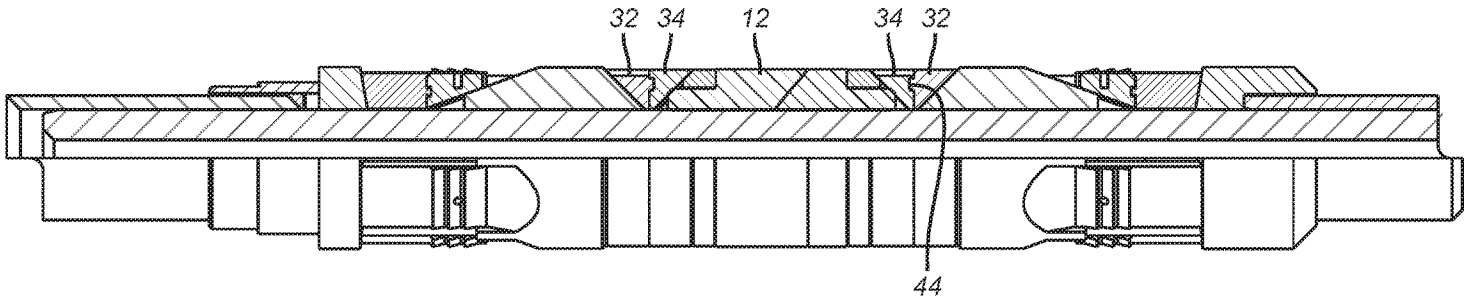
FIG. 2 is a part section view of an embodiment with segmenting rings on opposed sides of the sealing element in the run in position.
Figure 3:
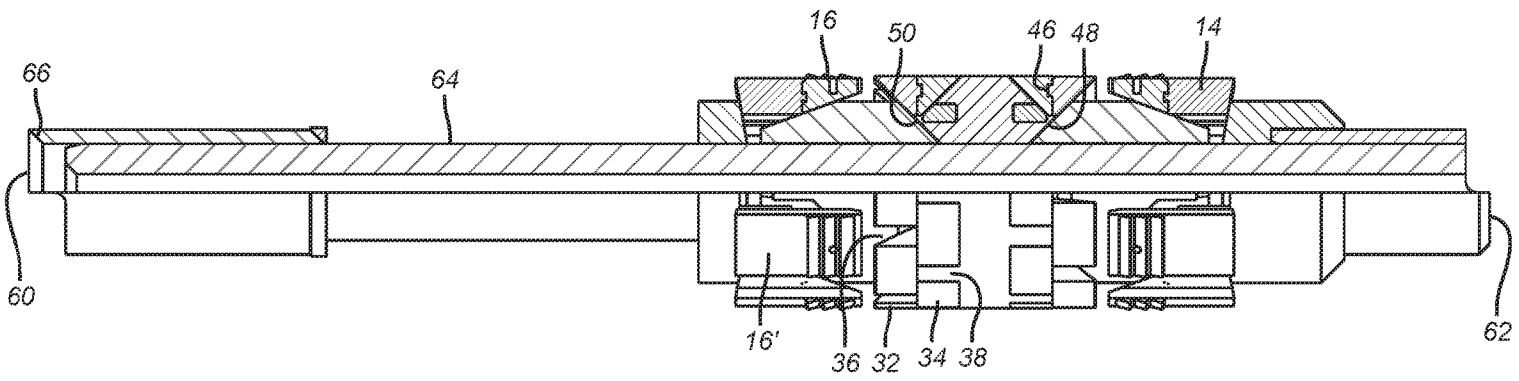
FIG. 3 is the view of FIG. 2 in the set position.
Figure 5:
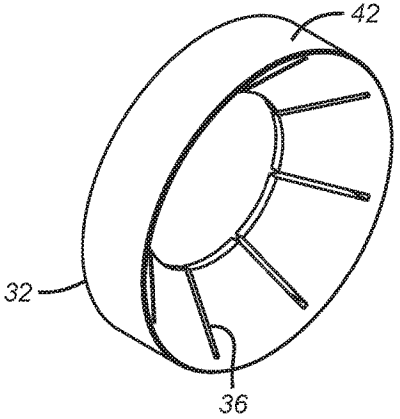
FIG. 5 is a perspective view of a companion ring to the ring of FIG. 4.
Figure 4:
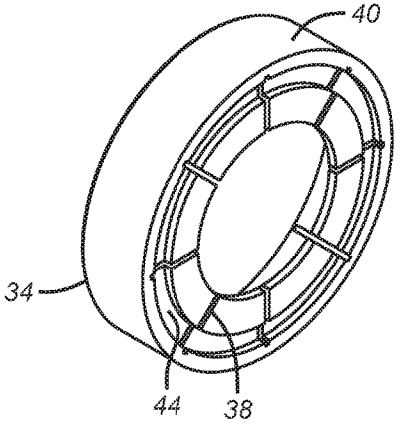
FIG. 4 is a perspective view of one of the segmenting backup rings.

FIG. 2 illustrates adjacent backup ring shapes 32 and 34 that each have a right triangle shape in section and the shape of an equilateral triangle when abutted. Initially, before setting, the rings can be whole for 360 degrees as shown in FIGS. 4 and 5 or they can have a gap or space such that the outer surfaces 40 and 42 do not extend for 360 degrees. In that case the gap in one ring will be offset from the gap in an adjacent ring. The gap facilitates expansion by reducing resistance to the expansion. Both variations are encompassed by the term "ring shaped." The rings 32 and 34 have scores or slots 36 and 38 respectively that preferably do not extend to respective outer surfaces 40 and 42. There are grooves 44 in ring 34 that register with projections 46 in ring 32. In essence, for running in the rings 32 and 34 are rotationally locked. There are sufficient pairs of grooves 44 and projections 46 to keep the relative positions of segments of each ring that are adjacent from relatively rotating when the segments are created by forcing the rings 32 and 24 up cones 48 and 50 for the FIG. 3 set position. Looking at FIG. 3 it can be seen that the gaps 36 are overlaid with segments that were ring 34 and that the gaps 38 are overlaid with segments that were ring 32. The same effect is achieved on opposed ends of the sealing element 12. Additionally, slips 14 and 16 that initially started out as a ring and on setting in the FIG. 3 position are now segments, are in general alignment with the gaps in the outermost backup ring. For example, slip segment 16' is in axial alignment with gaps 36. Since the slips need to anchor before the sealing element 12 is compressed between cones 48 and 50 FIG. 3 shows the slip segments on opposed ends of the sealing element 12 as axially spaced from the outermost backup ring on opposed sides of the sealing element.

The rings 32 and 34 are preferably non-metallic and are generally an easy to drill composite material. The sides of each of the rings are slanted to an equal angle as the cones 48 and 50. This feature facilitates the movements needed to go from the run in position of FIG. 2 to the set position of FIG. 3. Plugs 10 are particularly suited to be used in treating a formation such as stimulation, fracturing or injection. Since many plugs 10 are used in fracturing, the ability to mill them out rapidly is enabled by the backup ring system described above where the rings are preferably composite and break into gapped segments in a way that gaps in one ring are overlapped with segments of an adjacent ring to preclude extrusion gaps when the sealing element 12 is compressed.

The ends 60 and 62 of the mandrel 64 can also have a pattern of spaced projections or some other interlocking feature 66 so that if there is a release during milling out that the features 66 of one plug 10 engage the opposing feature 66 of the next plug 10 so that they rotationally lock to facilitate the continuation of the milling out procedure.

The plug 10 is predominantly non-metallic having slips, mandrel and cones as non-metallic and the sealing element being rubber. In the FIGS. 2 and 3 the backup rings are also preferably composite to allow the plug 10 to be essentially all non-metallic whereas in the FIG. 1 embodiment with the metal petal rings in rows 24 and 26 the plug 10 is still over 85% non-metallic and is "essentially non-metallic."

In the illustrated design in FIGS. 2 and 3 the cones 48 and 50 have opposing ramps with the outer ramps handling the movement of the slips and the inner ramps that face the sealing element 12 guiding out the joined backup rings 32 and 34.

The above description is illustrative of the preferred embodiment and many modifications may be made by those skilled in the art without departing from the invention whose scope is to be determined from the literal and equivalent scope of the claims below:

We claim:

1. A removable plug assembly for a subterranean locations accessible through a tubular string, comprising:

at least one mandrel;

at least one slip on said mandrel selectively actuated to contact the tubular string to anchor said mandrel;

a sealing element on said mandrel further comprising a backup ring shaped assembly on opposed sides thereof, said backup ring shaped assembly on at least one side further comprising a plurality of stacked rings each further comprising segments, said rings are triangular in section and abut to form a wedge shape in section pointed toward said mandrel, said segments separate to form unrestrained gapped segments when actuated toward the tubular string.

2. The assembly of claim 1, wherein:

gaps between segments of one of said ring shapes are disposed against segments of an adjacent said ring shape.

3. The assembly of claim 2, wherein:

said plurality of ring shapes are rotationally locked before separation into said segments.

4. The assembly of claim 3, wherein:

said segments from one of said ring shapes are secured to adjacent segments from another of said ring shapes after said segments are formed.

5. The assembly of claim 3, wherein:

said rotational locking is accomplished with a projection on one of said ring shapes engaging a recess on another of said ring shapes.

6. The assembly of claim 1, wherein:

said backup ring shaped assembly is non-metallic.

7. The assembly of claim 6, wherein:

said backup ring shaped assembly is made of a composite material.

8. The assembly of claim 1, wherein:

said ring shapes have circumferentially offset slots that extend to a location short of an outer surface of said ring shapes.

9. The assembly of claim 1, wherein:

said ring shapes have circumferentially offset scores that extend to a location short of an outer surface of said ring shapes.

10. The assembly of claim 1, wherein:

said plurality of ring shapes are rotationally locked before separation into said segments.

11. The assembly of claim 10, wherein:

said rotational locking is accomplished with a projection on one of said ring shapes engaging a recess on another of said ring shapes.

12. The assembly of claim 11, wherein:

said backup ring shaped assembly is non-metallic.

13. The assembly of claim 12, wherein:

said ring shapes have circumferentially offset slots that extend to a location short of an outer surface of said ring shapes.

14. The assembly of claim 12, wherein:

said ring shapes have circumferentially offset scores that extend to a location short of an outer surface of said ring shapes.

15. The assembly of claim 12, wherein:

said backup ring shaped assembly is made of a composite material.

16. The assembly of claim 1, wherein:

said segments from one of said ring shapes are secured to adjacent segments from another of said ring shapes after said segments are formed.

17. The assembly of claim 1, wherein:

said ring shapes each initially comprise a gap before expansion and said gaps are circumferentially offset.

18. A method of performing a subterranean operation using the assembly of claim 1.

19. The method of claim 18, wherein the subterranean operation comprises treating a subterranean formation.

* * * * *